United States Patent [19]

Monser

[11] Patent Number: 4,531,131

[45] Date of Patent: Jul. 23, 1985

[54] RIDGED WAVEGUIDE ANTENNA WITH CONCAVE-SHAPED SIDEWALLS

[75] Inventor: George J. Monser, Goleta, Calif.

[73] Assignee: Raytheon Company, Lexington, Mass.

[21] Appl. No.: 448,877

[22] Filed: Dec. 10, 1982

[51] Int. Cl.[3] ..... H01Q 13/02

[52] U.S. Cl. ..... 343/786

[58] Field of Search ..... 343/753, 771, 772, 776, 343/778, 786

[56] References Cited

U.S. PATENT DOCUMENTS

| | | | |
|---|---|---|---|
| 2,398,095 | 4/1946 | Katzin | 343/786 |
| 3,698,000 | 10/1972 | Landry | 343/786 |
| 4,063,248 | 12/1977 | Debski et al. | 343/778 |
| 4,353,072 | 10/1982 | Monser | 343/725 |
| 4,353,074 | 10/1982 | Monser et al. | 343/786 |

OTHER PUBLICATIONS

Landstorfer et al., "Very Short Horn Antennas for Arbitrary Polarization," Proceedings-9th European Microwave Conference, Brighton, England, 17-20 Sep. 1979, pp. 186-190.

*Primary Examiner*—Eli Lieberman
*Assistant Examiner*—Michael C. Wimer
*Attorney, Agent, or Firm*—Richard M. Sharkansky; Joseph D. Pannone

[57] ABSTRACT

A radio frequency antenna comprising a rectangular waveguide having opposing relatively concave-shaped narrow side wall portions extending from a rear wall of the waveguide structure to an aperture of the antenna element. The separation between the sidewalls, at a distance intermediate the rear wall and the aperture, is greater than the width of the aperture. The waveguide includes a ridge-shaped feed structure extending from the rear wall to the aperture. A pair of ground plane conductors having surfaces each with an edge terminating along an aperture edge of a corresponding one of the sidewalls at the periphery provide a pair of aperture edges. Each one of the ground plane conductors extends for a length greater than $\lambda/3$ where $\lambda$ is the wavelength at the lowest operating frequency of the antenna. With such arrangement, an antenna element is provided having a relatively constant beam width over the operating bandwidth of the antenna.

4 Claims, 9 Drawing Figures

RIDGED WAVEGUIDE ANTENNA WITH CONCAVE-SHAPED SIDEWALLS

BACKGROUND OF THE INVENTION

This invention relates generally to radio frequency antennas and more particularly to radio frequency antennas adapted to operate over relatively wide frequency bandwidths.

As is known in the art, many installations for array antennas impose physical constraints on the size of such antennas. For example, in an airborne installation each one of the antenna elements in the array thereof should have minimum depth, width and thickness. Further, in many applications it is necessary that the antenna provide a relatively constant beam width over a relatively wide frequency bandwidth.

SUMMARY OF THE INVENTION

A radio frequency antenna comprising a rectangular waveguide having opposing relatively concave-shaped narrow side wall portions extending from a rear wall of the waveguide structure to an aperture of the antenna element. The separation between the sidewalls, at a distance intermediate the rear wall and the aperture, is greater than the width of the aperture. The waveguide includes a ridge-shaped feed structure extending from the rear wall to the aperture. A pair of ground plane conductors having surfaces each with an edge terminating along an aperture edge of a corresponding one of the sidewalls at the periphery provide a pair of aperture edges. Each one of the ground plane conductors extends for a length greater than $\lambda/3$ where $\lambda$ is the wavelength at the lowest operating frequency of the antenna. With such arrangement, an antenna element is provided having a relatively constant beam width over the operating bandwidth of the antenna.

BRIEF DESCRIPTION OF THE DRAWINGS

The foregoing features of this invention, as well as the invention itself, may be more fully understood from the following description read together with the accompanying drawings, in which.

DESCRIPTION OF THE PREFERRED EMBODIMENT

Figure 1:
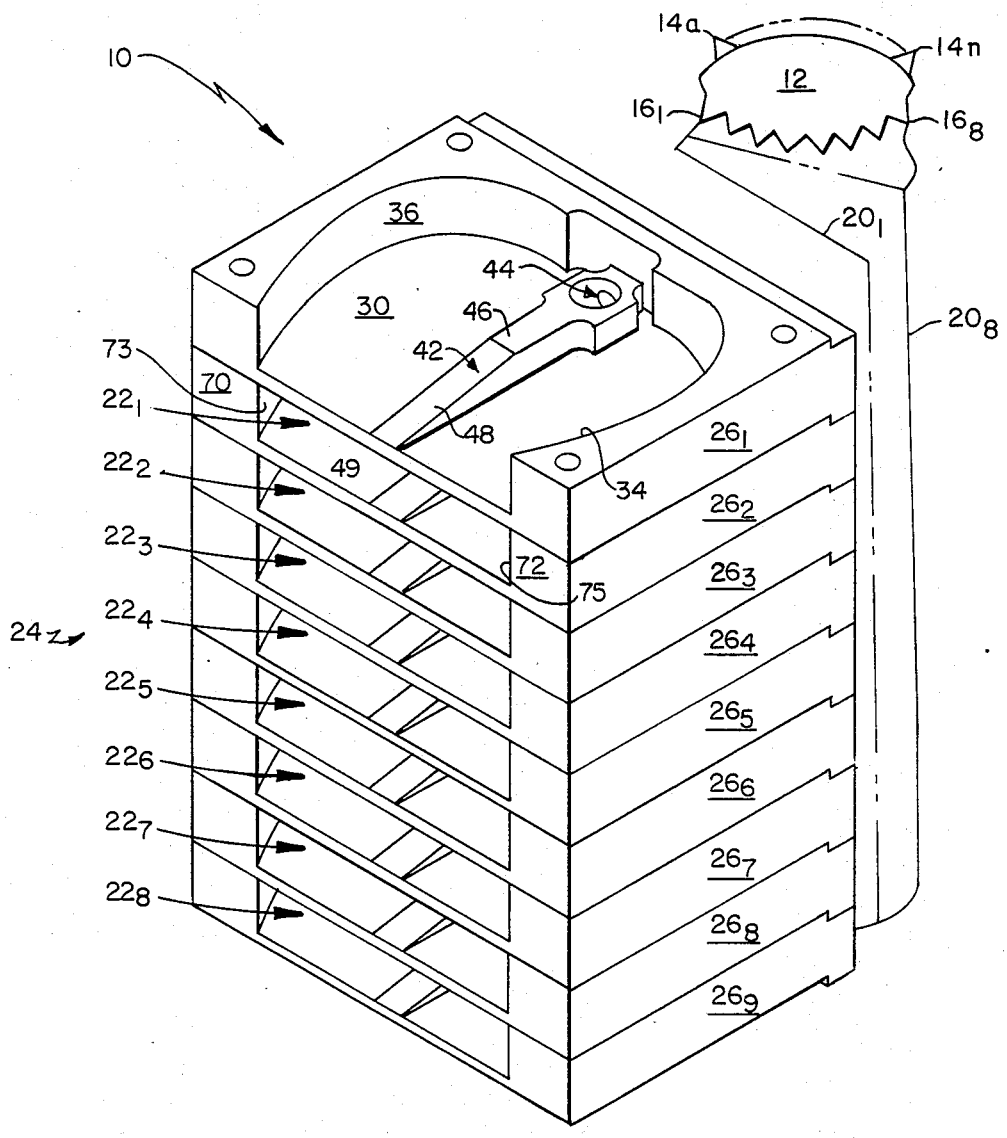
FIG. 1 is a radio frequency antenna system including an array of antenna elements according to the invention.
Figure 4:
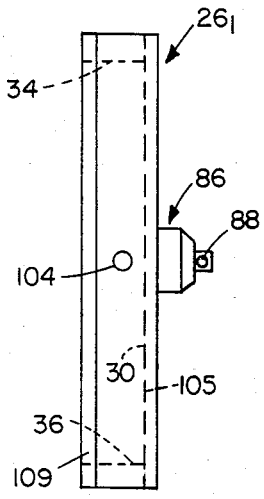
FIG. 4 is an end elevation view of the member of FIG. 2.
Figure 3:
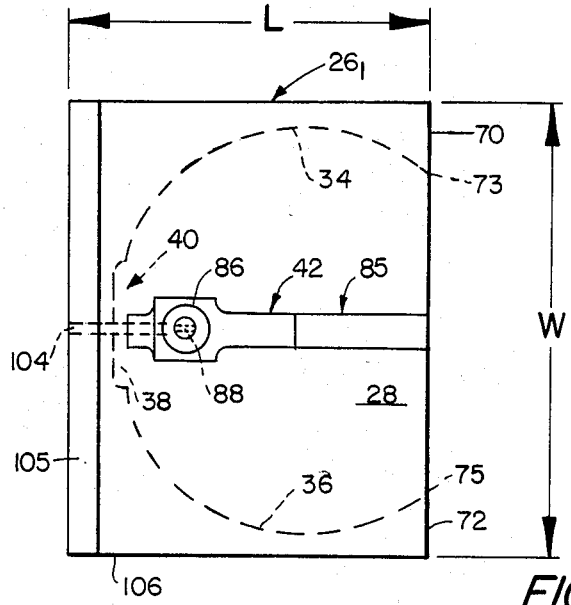
FIG. 3 is a bottom plan view of the member of FIG. 2.
Figure 5:
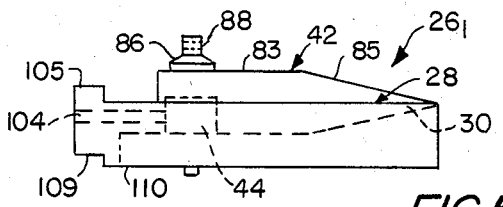
FIG. 5 is a side elevation view of the members of FIG. 2.
Figure 2:
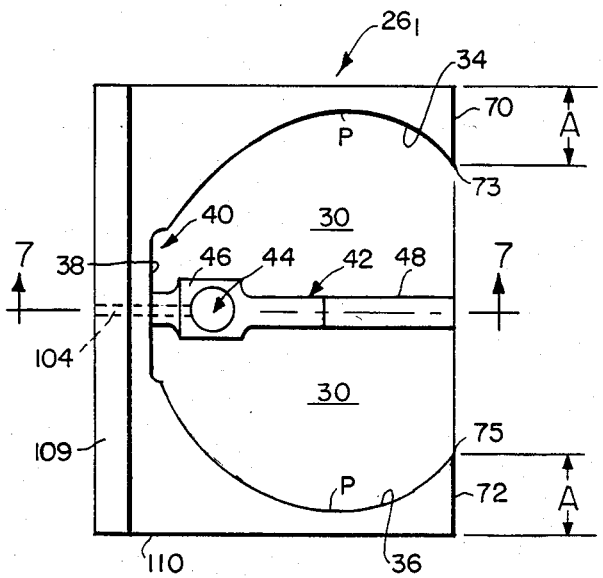
FIG. 2 is a top plan view of a member used to form one of the antenna elements of FIG. 1.

Referring now to FIG. 1, a multibeam radio frequency antenna system 10 adapted to operate over a relatively wide band of frequencies, here from 5.0 GHZ to 18.0 GHZ, is shown to include a radio frequency lens 12 having a plurality of feedports 14*a* to 14*n* disposed along a portion of the periphery of such lens 12 and a plurality of, here 8, array ports $\mathbf{16}_1$ to $\mathbf{16}_8$ disposed along an opposing portion of the periphery of such lens 12, each one of the plurality of array ports $\mathbf{16}_1$ to $\mathbf{16}_8$ being coupled to a corresponding one of a like plurality of antenna elements $\mathbf{22}_1$ to $\mathbf{22}_8$, in an array 24, through a corresponding one of a plurality of coaxial transmission lines $\mathbf{20}_1$ to $\mathbf{20}_8$, as shown. The shape of the lens 12, the lengths of the transmission lines $\mathbf{20}_1$ to $\mathbf{20}_8$ and the arrangement of the antenna elements of $\mathbf{22}_1$ to $\mathbf{22}_8$ are such that n collimated beams of radio frequency energy are formed in free space by the antenna system 10, each one of such n beams having a different direction, as described in U.S. Pat. No. 3,761,936, issued Sept. 25, 1975, "Multi-Beam Array Antenna", Inventors Donald H. Archer, Robert J. Prickett and Curtis P. Hartwig and assigned to the same assignee as the present invention.

Figure 6:
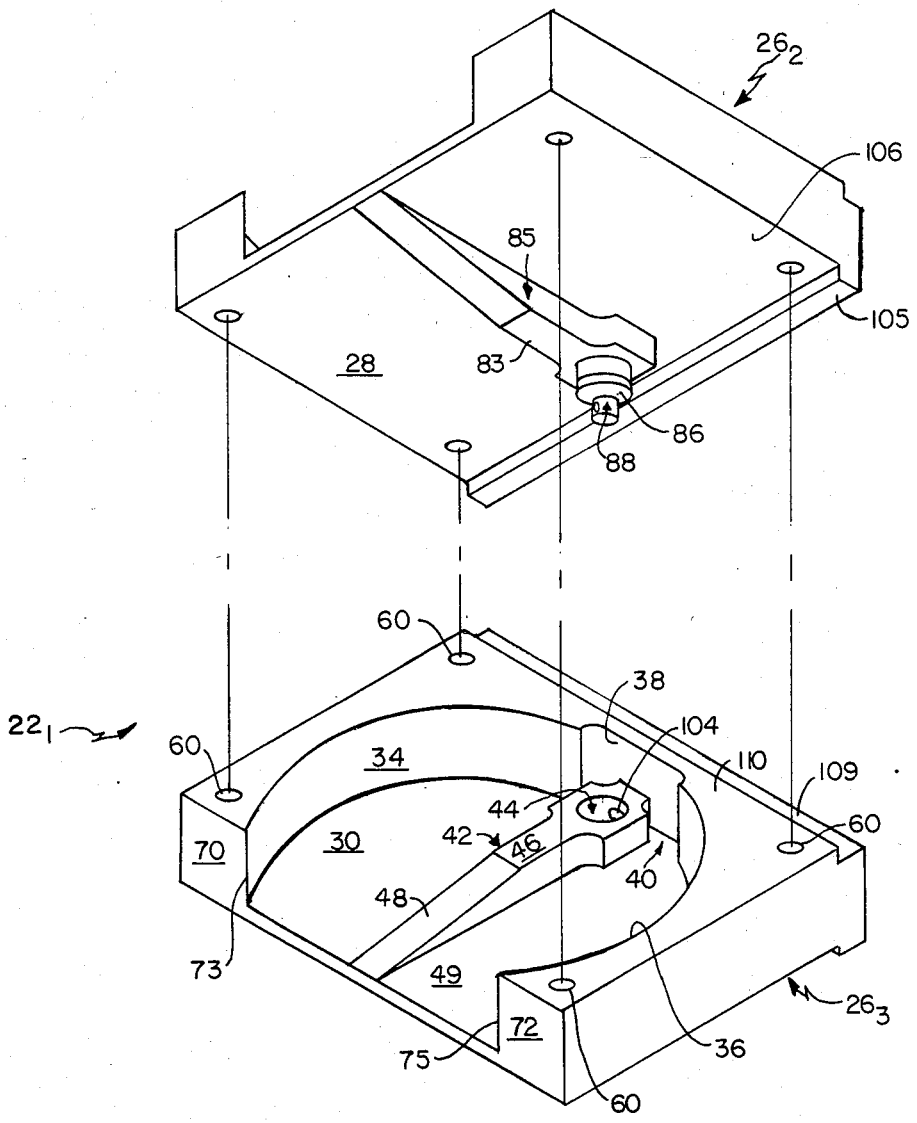
FIG. 6 is an exploded, isometric view of a pair of the members shown in FIGS. 2–5, such pair of members forming, when affixed to each other, one of the antenna elements of FIG. 1.
Figure 7:
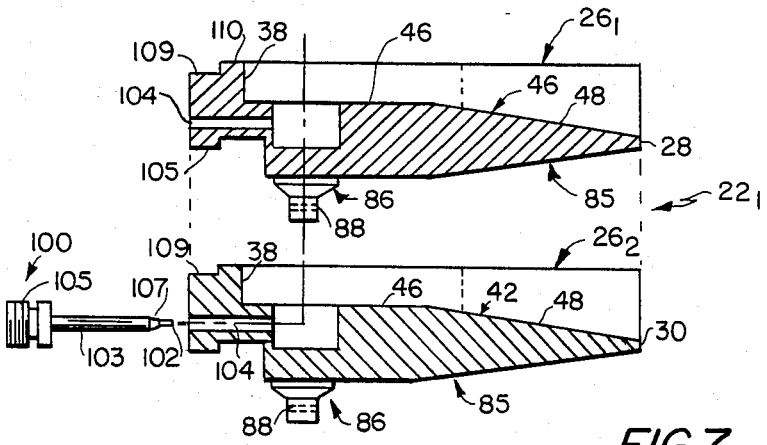
FIG. 7 is an exploded cross-sectional side elevation view of the pair of members of FIG. 6 and a feed probe, such pair of members of FIG. 6 and feed probe forming the antenna element of FIG. 6, such cross-section being taken along lines 7—7 of FIG. 2.
Figure 8:
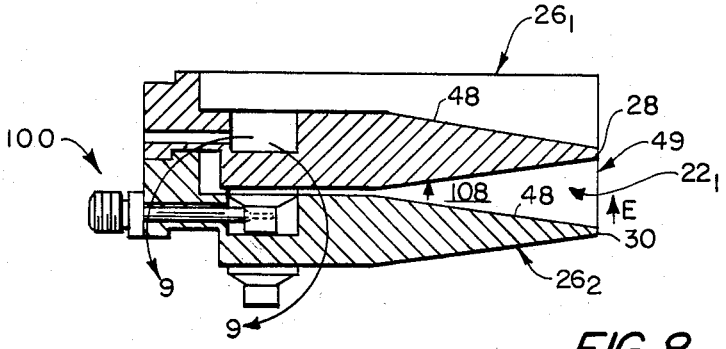
FIG. 8 is a cross-sectional side elevation view of the pair of members of FIG. 7 and feed probe affixed together to form the antenna element of FIG. 7.

Array 24 includes a plurality of, here 8, identically constructed conductive members $\mathbf{26}_2$ to $\mathbf{26}_9$, an exemplary one of such members $\mathbf{26}_2$ to $\mathbf{29}_9$, here member $\mathbf{26}_2$ being shown in detail in FIGS. 2–5, a pair of such members $\mathbf{26}_2$ to $\mathbf{26}_9$ forming one of the 8 identical constructed antenna elements $\mathbf{22}_1$ to $\mathbf{22}_8$. Thus, an exemplary one of the antenna elements $\mathbf{22}_1$ to $\mathbf{22}_8$, here antenna element $\mathbf{22}_1$, includes member $\mathbf{26}_1$ and $\mathbf{26}_2$, as shown in FIGS. 6, 7 and 8.

Referring now in more detail to members $\mathbf{26}_1$ to $\mathbf{26}_9$, each one of such members $\mathbf{26}_1$ to $\mathbf{26}_9$ is constructed from a block of electrically conductive material, here aluminum, here having outer dimensions of 1.75 inches (length L) and 2.25 inches (width W). The upper surface of such block, as shown more clearly in FIG. 6 for member $\mathbf{26}_2$ has machined therein outwardly bow-shaped (or concave) side wall portions 34, 36 (FIG. 2) and a rear wall portion 38 having a recess notch 40 formed therein. The depth of the side wall and rear wall portions is here 0.36 inches. Also machined into the upper surface 30 of the members $\mathbf{26}_1$ to $\mathbf{26}_9$ is a tapered ridge 42, as shown, here having a width of 0.19 inches. The tapered ridge 42 has an aperture 44 formed in the upper, flat top portion 46 thereof, the flat top portion 46 terminating in a tapered portion 48, (FIGS. 5, 6, 7) as shown. The length of the tapered portion 48 is here 0.9 inches. The distant end of the tapered portion 48 terminates at the open end of the waveguide (i.e. at the aperture 49 of the antenna element). The depth of the notch 40 formed in the rear wall portion 38 is here 0.075 inches, such notch 40 having a length along the rear wall portion 38 of, here, 0.588 inches. It is noted that the separation between the side wall portions 34, 36 disposed laterally of the tapered portion 48 increases progressively from the rear wall to a point P approximately 0.8 inches from the aperture and thus such separation decreases to 0.95 inches at the aperture. As will be discussed in more detail hereinafter, converging the side wall portions 34, 36 as they extend towards the rear wall portion 38 in the region behind the aperture 44

(such aperture being the area where the antenna element $22_1$ formed by such member $26_1$ together with member $26_2$ is fed by the coaxial transmission line $20_1$, (FIG. 1) in a manner to be described) improves the impedance matching between the coaxial transmission line $20_1$, (here a 50 ohm line) and the antenna element $22_1$. Member $26_2$ also has holes 60 drilled through it, such being used for bolting the members together with bolts and nuts (not shown).

A pair of ground plane surfaces 70, 72 of the member $26_2$, (FIG. 6) have edges 73, 75 terminating along the aperture 49 and the sidewalls 34, 36. Thus, the ground plane surfaces 70, 72 are adapted to allow flush-surface mounting of this antenna within an airborne vehicle (not shown).

Figure 9:
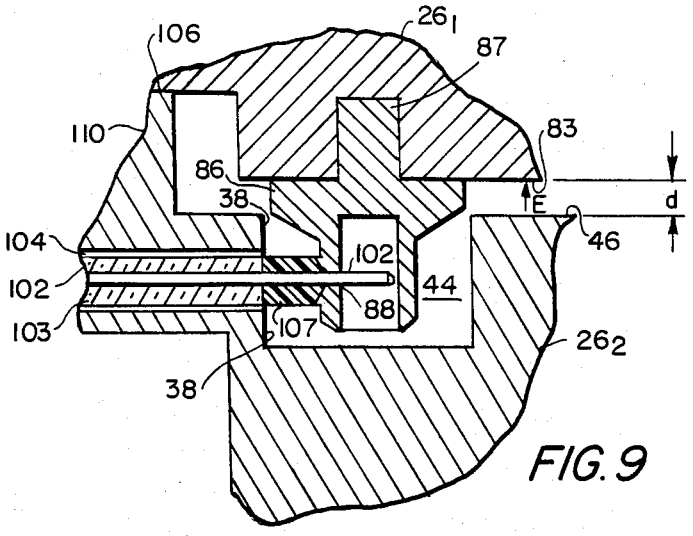
FIG. 9 is a cross-sectional view showing a portion of the feed probe and a portion of the pair of members, such FIG. being of region 9—9 of FIG. 8.

Referring now to the bottom surface 28 of member $26_1$ (shown more clearly in FIGS. 3–6) such surface 28 also has a tapered ridge 85 formed thereon; here, however, the flat portion 83 of the ridge 85 has a turret shaped conductive post 86 (here shown) press fit therein by a pin-shaped end 87 as shown in FIG. 9. Post 86 has a hole 88 drilled therein as shown for receiving the center conductor 102 of a coaxial connector 100 (FIGS. 7 and 8) in a manner to be described in detail in connection with FIG. 9. It is noted from FIGS. 3 and 5 that the tapered ridges 48, 85 formed on the upper and lower surfaces of member $26_1$ are in alignment or registration with each other. Further, it is evident from FIGS. 2–6 that the post 86 of member $26_1$ fits into the aperture 44 of member $26_2$ as shown in FIGS. 7, 8 and 9.

When members $26_1$, $26_2$ are affixed together, the lower surface 28 of member $26_1$, and the upper surface 30 of member $26_2$ form opposing upper and lower wide surfaces of a hollow rectangular, open ended waveguide structure and side wall portions 34, 36 and rear wall portion 38 form narrow side and rear walls of such open ended, rectangular waveguide. More particuarly, the affixed members $26_1$, $26_2$ formed a tapered ridge rectangular waveguide antenna element $22_1$. Surfaces 105, 106 of member $26_1$ contact surfaces 109, 110 of member $26_2$ respectively as shown in FIG. 6 so that the flat portions 46, 83 of the ridges 42, 85 are separated a distance "d" (FIG. 9), and the side walls of the waveguide, i.e. surfaces 28, 30 are separated a distance "b". The distances "b" and "d" are designed so that the waveguide propagates in the $TE_{10}$ mode. Here, "d" is 0.045 inches and "b" is 0.325 inches. The tapered ridge waveguide antenna elements $22_1$ to $22_8$ are fed by the coaxial transmission line $20_1$ to $20_8$ through coaxial connectors 100 (FIGS. 7, 8) having a center conductor 102 (FIG. 9) passing through hole 104 (FIGS. 7, 9) and the end of such center conductor 102 press fit to post 86 to provide electrical and mechanical contact to post 86. The outer conductor 105 is electrically and mechanically connected to the member $26_2$ through screws (not shown). The inner conductor 102 is separated from the walls of the hole 104 by a dielectric sleeve 103 as shown. A ferrite ring 107 is disposed around the inner conductor 102 between the dielectric 103 and the post 86, as shown in FIG. 9 to provide impedance matching between the coaxial connector 100 and the post 86. Radio frequency energy fed to the antenna element $26_1$ via connector 100 thus launches radio frequency energy into cavity 108 (FIG. 8). The gradually curved contours of the side walls to the relatively narrow aperture permits the electric field to continue to propagate towards the reduced aperture 49. The ground plane conductors' surfaces define the beamwidth of the height-plane and provide approximately constant beamwidth in the width dimension W as a function of frequency. There, the length A (FIG. 2) of each of the ground plane conductors 70, 75 is 0.36 inches. The dimension A is constrained and that in a particular array it would not exceed $\lambda/2$ at the upper frequency. It could, however, be changed for non-array applications. In any event, the length A should be greater than $\lambda_L/3$ where $\lambda_L$ is the wavelength at the lowest operating frequency to provide a substantially constant beamwidth over the operating band of frequencies. The launched energy then travels towards the open end or aperture 49 of the cavity in the $TE_{10}$ mode having an electric field vector extending between the wide surfaces of the waveguide as shown by arrow E in FIGS. 8 and 9.

Having described a preferred embodiment of the invention, it is now evident that other embodiments incorporating these condepts may be used. It is felt, therefore, that the invention should not be restricted to the disclosed embodiment but rather should be limited only by the spirit and scope of the appended claims.

What is claimed is:

1. A radio frequency antenna element, comprising: a rectangular waveguide structure with concave-shaped narrow side walls extending from a rear wall of the waveguide structure to an aperture of the antenna element, such narrow side walls having a separation therebetween which progressively increases as the sidewalls extend from the rear wall to a point spaced from the aperture then progressively decreases as the side walls extend from such point to the aperture; a ridge-shaped feed structure disposed between and spaced from such narrow side walls extending from the rear wall to the aperture; and, a pair of ground plane conductors, each one thereof having surfaces with an edge terminating along an aperture forming edge of a corresponding one of the side walls at the periphery of the aperture to provide a pair of narrow aperture edges.

2. The antenna recited in claim 1 wherein each one of the ground plane conductors extends for a length greater than $\lambda/3$ where $\lambda$ is the wavelength of the lowest operating frequency of the antenna element.

3. The antenna element recited in claim 1 wherein the separation between the narrow side walls at a distance intermediate the rear wall and aperture is greater than the separation between the pair of aperture edges.

4. The radio frequency antenna recited in claim 3 wherein the rectangular waveguide structure includes a block of conductive material, and wherein the pair of sidewalls is formed within the block with portions of such block being disposed between the formed sidewalls and a pair of outer surfaces of such block, and wherein the pair of ground plane conductors extend from the outer surfaces to the narrow sidewalls at the aperture.

* * * * *